US005929407A

United States Patent [19]

Ziem

[11] Patent Number: 5,929,407

[45] Date of Patent: Jul. 27, 1999

[54] PLUNGER ACTUATED SWITCH WITH SINGLE ADJUSTMENT FEATURES

[75] Inventor: Daniel T. Ziem, Batavia, Ill.

[73] Assignee: Eaton Corporation, Cleveland, Ohio

[21] Appl. No.: 09/026,272

[22] Filed: Feb. 19, 1998

[51] Int. Cl.[6] ..... H01H 3/14

[52] U.S. Cl. ..... 200/61.89; 200/16 B; 200/61.76; 200/345

[58] Field of Search ..... 200/16 B, 16 E, 200/61.88, 61.89, 61.91, 520–535, 341–345

[56] References Cited

U.S. PATENT DOCUMENTS

| | | | |
|---|---|---|---|
| 3,710,048 | 1/1973 | Schumacher | 200/16 B X |
| 4,123,640 | 10/1978 | Ballantyne | 200/61.76 X |
| 4,137,440 | 1/1979 | Bryant | 200/61.89 X |
| 4,316,065 | 2/1982 | Rupp et al. | 200/61.89 |
| 4,406,935 | 9/1983 | Montag et al. | 200/61.82 |
| 4,492,833 | 1/1985 | Malesko | 200/61.78 |
| 5,162,625 | 11/1992 | Comerford | 200/61.89 |
| 5,241,144 | 8/1993 | Meagher et al. | 200/61.89 |
| 5,512,717 | 4/1996 | Magome et al. | 200/345 X |
| 5,826,709 | 10/1998 | Jacob | 200/345 |

*Primary Examiner*—J. R. Scott
*Attorney, Agent, or Firm*—Roger A. Johnston

[57] ABSTRACT

A plunger actuated switch, suitable for automotive brake light applications where the plunger is held depressed in de-actuated condition. Upon installation, the switch housing is moved on an adjustable mounting to cause the plunger to contact a user moveable operating member such as a brake pedal arm. The switch mounting is adjusted to cause the plunger to depress and move the internal switch actuator to its limit of travel; and, the switch is further adjusted to cause the plunger to ratchet over an adjustment member carried by the actuator to provide an adjusted position of the switch. The adjustment member has spring fingers which are bowed during the adjustment; and, upon subsequent release of the user moved operating member, i.e., a brake pedal arm, the plunger is spring biased away from the fingers which snap inwardly to thereafter permit relative motion of the plunger with respect to the actuator when the actuator is at its travel limit to thereby provide overtravel absorption.

11 Claims, 2 Drawing Sheets

PLUNGER ACTUATED SWITCH WITH SINGLE ADJUSTMENT FEATURES

CROSS-REFERENCE TO RELATED APPLICATIONS

Not Applicable

BACKGROUND OF THE INVENTION

The present invention relates to plunger actuated switches and particularly switches of this type which are actuated by user movement of an operating member which contacts the plunger of the switch. In applications of this sort, the plunger actuated switch must be installed or mounted proximate the operating member moved by the user such that the operating member is properly positioned to contact the plunger and effect switch actuation in a desired point in time or position relative to the movement of the operating member by the user. In order to accomplish this, the switch mounting must be adjustable so as to position the at-rest position of the switch plunger properly with respect to the at-rest position of the operating member to be moved by the user.

A particular application of a plunger actuated switch is that encountered in automotive stop lamp switches where the switch is mounted in the vehicle and initially positioned with respect to the at-rest position of the brake pedal arm such that the plunger is depressed de-actuating the switch; and, upon user movement of the brake pedal arm, the switch plunger is permitted to extend and cause actuation of the switch contacts for energizing the vehicle stop lamps or brake lights.

During a typical automotive vehicle assembly in high volume mass production, the stop lamp switch is installed on a mounting bracket and moveably positioned thereon until the switch plunger contacts the brake pedal arm in its at-rest position against a travel-limiting stop or pad; and, the plunger is depressed sufficiently to de-actuate the internal switch contacts. The stop lamp switch is then secured in this adjusted position with the brake pedal at rest against its stop or limit pad. This technique of installation and adjustment has employed for known stop lamp arrangements, such as that shown and described in U.S. Pat. No. 5,162,625 issued in the name of John Comerford which describes a stop lamp switch having annular ribs on the plunger frictionally engaged by a clip provided in the actuator for adjusting the length of the plunger/actuator combination for initially positioning the de-actuated switch with respect to a brake pedal arm.

However, in the process of installing and adjusting the switch of the aforesaid known ribbed plunger, the initial contact of the plunger with the brake arm causes the plunger to depress the actuator to the limit of its travel, or bottomed-out position with respect to the switch casing before the plunger is ratcheted to its adjusted position where it is maintained when the switch is secured on its mounting. With the switch actuator at the limit of its travel, in the aforesaid known switch construction, it is not possible for the switch to subsequently absorb any overtravel of the plunger.

This has caused problems in service for plunger actuated switches employed in automotive brake light applications where the at-rest position of the brake pedal arm changes over the life of the vehicle by virtue of changes in the pad employed for the limit stop of the brake arm for the at-rest position. This can occur where the limit stop is an elastomeric pad which undergoes compression setting over a period of time under the load of the return spring for the brake pedal arm.

Furthermore, in the event that the brake pedal arm is moved against its limit stop pad by additional forces, as for example the vehicle operator pulling up on the brake pedal arm, the brake light switch plunger/actuator undergoes additional adjustment movement: this additional movement changes the at-rest position of the switch actuator with respect to the internal contacts and thus alters the point of switch actuation with respect to the brake pedal arm and may result in the brake lights not being de-energized in the pedal arm at-rest position.

Accordingly, it has been desired to provide a plunger actuated switch which may be installed against a user moveable operating member and adjusted in one operation at the time of installation with the plunger depressed in the at-rest position of the user operating member with the internal actuator of the switch at its travel limit and yet which is capable of thereafter absorbing overtravel from the at-rest position.

BRIEF SUMMARY OF THE INVENTION

The present invention provides a plunger actuated switch of the type installed deactuated with the plunger and actuator fully depressed to the limit of actuator travel for maintaining the switch in the de-actuated position. The present invention is particularly suitable for an automotive stop lamp application. The plunger of the present invention has an adjustable engagement with the switch actuator to permit relative movement and latching therebetween upon initial installation to the adjusted position. Upon subsequent release of the plunger, a deflected spring mechanism is released which thereafter can absorb over-travel upon return of the switch plunger and actuator to the depressed at-rest position.

The present invention thus provides a solution to the above-described problem of providing a plunger actuated switch installed in the plunger and actuator depressed condition adjusted for contact with the user operated member where the switch is actuated by movement of the user operated member to release the plunger and which is capable of absorbing overtravel in the actuator depressed condition.

DETAILED DESCRIPTION OF THE INVENTION

Figures 1, 2, 3:
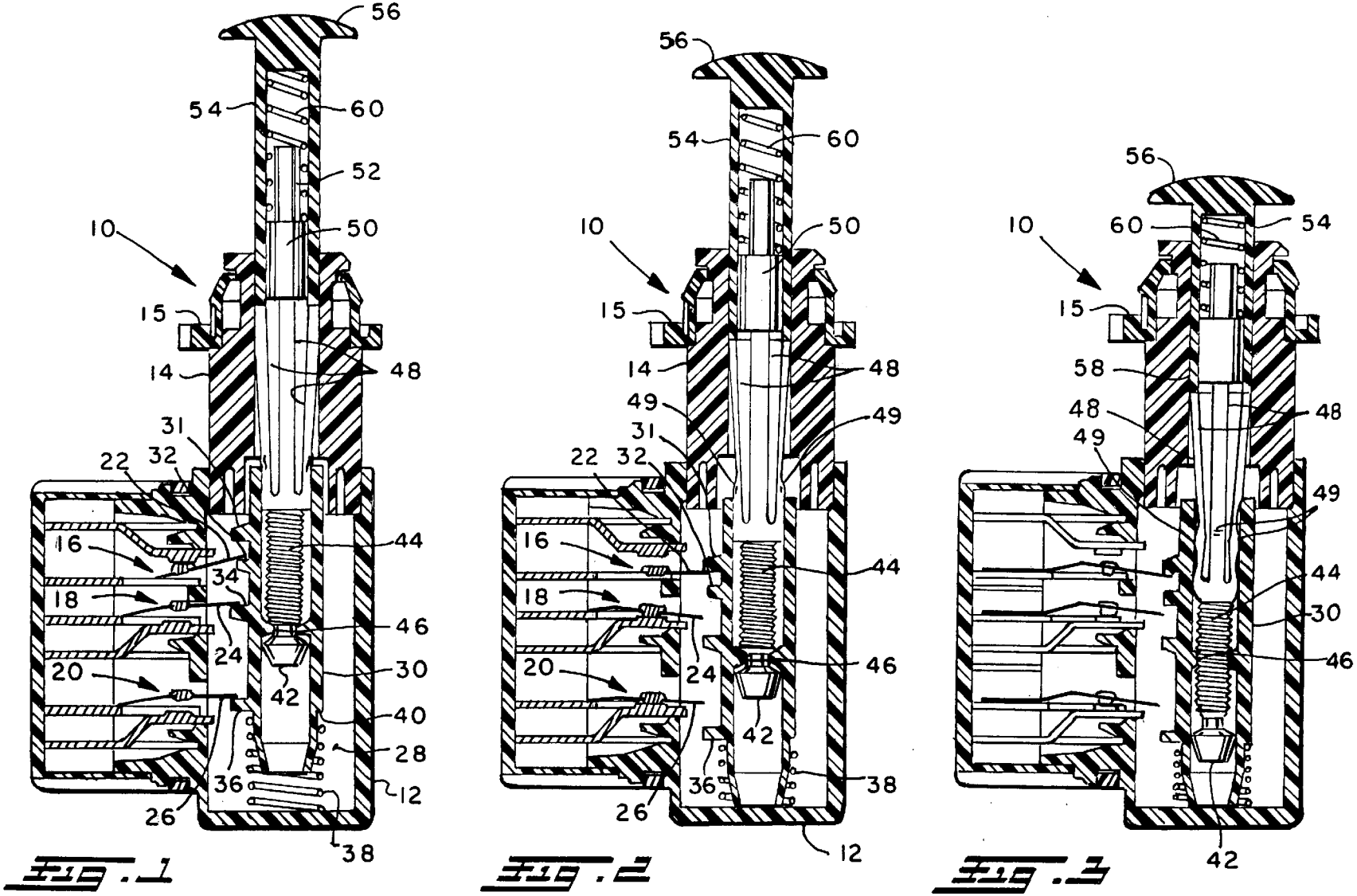
FIG. 1 is a cross-section of the switch assembly of the present invention with the plunger and adjustment member initially inserted into the housing and actuator.
FIG. 2 is a view similar to FIG. 1 with the plunger and actuator initially depressed to the actuator limit of travel from the position shown in FIG. 1.
FIG. 3 is a view similar to FIG. 2 with the plunger and adjustment member further depressed and to the switch adjusted position.

Referring to FIG. 1, the switch assembly of the present invention is indicated generally at 10 and includes a lower housing portion 12 and an upper housing mounting portion 14 provided with a mounting flange 15 with the lower housing having at least one, and preferably a plurality, of switches indicated generally at 16, 18, 20 each with a switch actuator blade 22, 24, 26 respectively extending into a hollow cavity 28 provided in the lower housing 12.

A switch actuator 30 member preferably having a generally tubular configuration is moveably disposed in the cavity 28 and has provided thereon suitable surfaces, such as projections 31, 32, 34, 36 spaced appropriately therealong, positioned for contacting blades 22, 24, 26 respectively and effecting actuation and deactuation of the switch as 16, 18, 20 respectively.

The lower end of actuator 30 is piloted in the upper end of a coil spring 38 which has its lower end registered against the bottom of cavity 28 and biases the actuator 30 in a upward direction by contact with an annular shoulder 40 provided on the actuator.

An adjustment member 42 is slidably received in the interior of the tubular actuator 30; and, adjustment member 42 has provided thereon a plurality of annular ribs or barbs 44 which are shown in FIG. 1 as disposed immediately adjacent and above a pair of oppositely disposed pawls or barbs 46 formed on the interior of the actuator 30. The upper part of actuator 42 has formed thereon a plurality of longitudinally extending circumferentially spaced radial spring fingers 48. Each of the spring fingers 48 has a cam surface 49 formed thereon which is configured to act against the inner diameter of the actuator 30. A guide portion or diameter 50 with a spring pilot portion 52 of reduced diameter from the guide portion 50 is provided adjacent the upper end of actuator 42.

A plunger 54 having a generally hollow tubular configuration has a button or head 56 provided on the upper end thereof. Plunger 54 is slidably received in the upper housing 14 in a bore 58 formed therein. The tubular plunger 54 is slidably received over the guide portion 50 of the switch adjustment member and is slidable between the guide portion 50 and the bore 58 in the upper housing 14.

A plunger return spring 60 is disposed interiorly of the plunger and has the lower end thereof registered on guide portion 50 with the upper end contacting the underside of the button 56.

The spring fingers 48 are extended outward to contact the inner surface of the bore 58 formed in the upper housing 14; and, as shown in FIG. 1, the lower end of the plunger 54 is registered against the upper ends of the spring fingers 48 at assembly. In the as assembled free state as shown in FIG. 1, the switch 16 is closed, switch 18 is open and switch 20 is open; as, the projections 32, 34, 36 are registered against the undersurface of the contact blades 22, 24, 26 respectively and hold the blades in an upward position.

Referring to FIG. 2, the plunger 56 has been moved by user movement of an operating member (not shown) in contact with button 56 and has caused the plunger to act against the end of fingers 48 and move the adjustment member and actuator 30 as a unit, downwardly compressing spring 38 until the lower end of actuator 30 reaches the limit of its travel and registers or "bottoms out" against the inside surface of lower housing 12. The actuator is shown in the "bottomed out" position in FIG. 2 wherein the projection 32 has permitted switch contact blade 22 to move downwardly to open switch 16; and, projections 34, 36 have permitted blades 24, 26 to move downwardly closing switches 18, 20 respectively.

It will be understood that the movement of the actuator to the position in FIG. 2 may be accomplished alternatively by movement of the switch housing 14, 12 on a suitable mount (not shown) to cause the button 56 to contact a stationary unshown user operating member to depress plunger 56 and cause the actuator 30 to move downwardly to the position shown in FIG. 2. It will be understood that this is the case when switch 10 comprises a brake light switch and is installed in a vehicle wherein button 56 is moved against the stationary unshown brake pedal arm.

Referring to FIG. 3, plunger 54 has been moved an additional distance downwardly from the position shown in FIG. 2 such as by further adjustment of the switch housing 14 on a mounting structure (not shown) and has caused the adjustment member 42 to be moved downwardly with respect to actuator 30 by ratcheting of the ribs 44 over the pawl or barbs 46 to an adjusted position as shown in FIG. 3.

As the adjustment member 42 is moved downwardly with respect to actuator 30, by compression loading of the spring fingers 48, the cam surfaces 49 are acted upon by the inner diameter of actuator 30 and cause the spring fingers 48 to be bowed inwardly as shown in FIG. 3. It will be understood that the downward movement of the plunger 54 to the position shown in FIG. 3 compresses spring 60 maintaining a reaction force against the undersurface of button 56. The upper ends of the spring fingers 48 are maintained in the outward position against the wall of the bore 58 by virtue of the force required to ratchet the ribs 44 with respect to pawl 46.

Figure 4:
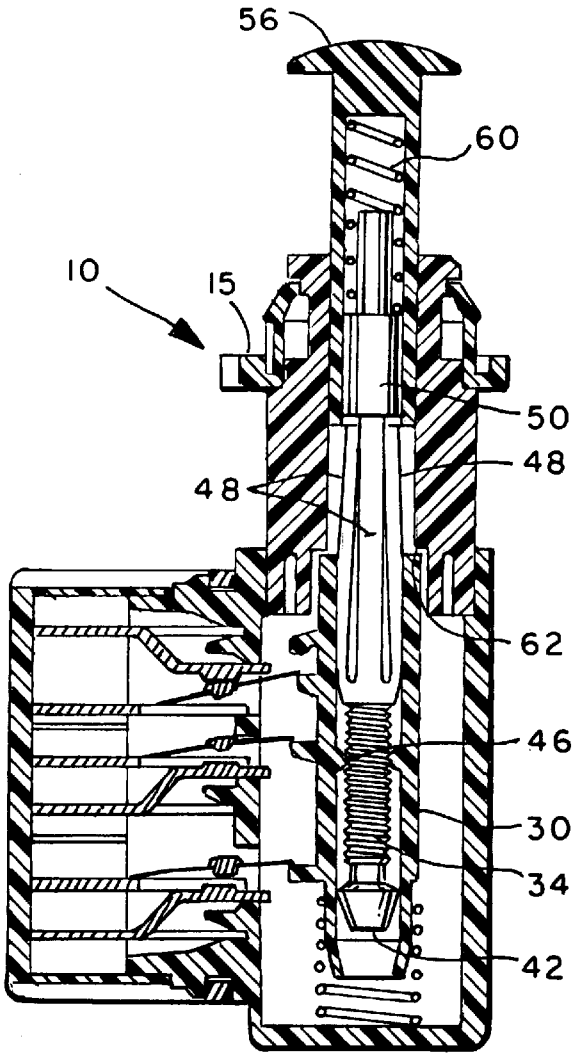
FIG. 4 is a view similar to FIG. 3 with the adjusted actuator and plunger in the released or free ion after adjustment; and, FIG. 5 is a view similar to FIG. 4 with the actuator subsequently fully depressed from the free position of FIG. 4 and with the plunger in an overtravel position.

Referring to FIG. 4, the adjusted switch 10 of FIG. 3 has been subsequently released from contact with an unshown user operating member, as for example a brake pedal arm, by user movement of the brake pedal arm away from the button 56 as would be the case in normal brake actuation in the vehicle. The plunger and button, and actuator are thus returned to their free position corresponding to the position of FIG. 1; however, it being understood that the adjustment member 42 is latched or retained in its adjusted position with respect to actuator 30 by the barbs or pawls 46 acting on the ribs 34.

It will be noted from FIG. 3 that the release of the plunger 54 and the movement upward under the bias of spring 60 releases the compression load on the spring fingers 48 inasmuch as the upper end of the actuator 30 is registered against a shoulder 62 provided in the upper housing 14 and spring 60 biases the lower end of the plunger away from the ends of the spring fingers 48 allowing the fingers to snap inwardly under the bias of cam surfaces 49. It will be understood that the spring fingers 48 are shown in the released or inwardly biased position in FIG. 4.

Figure 5:
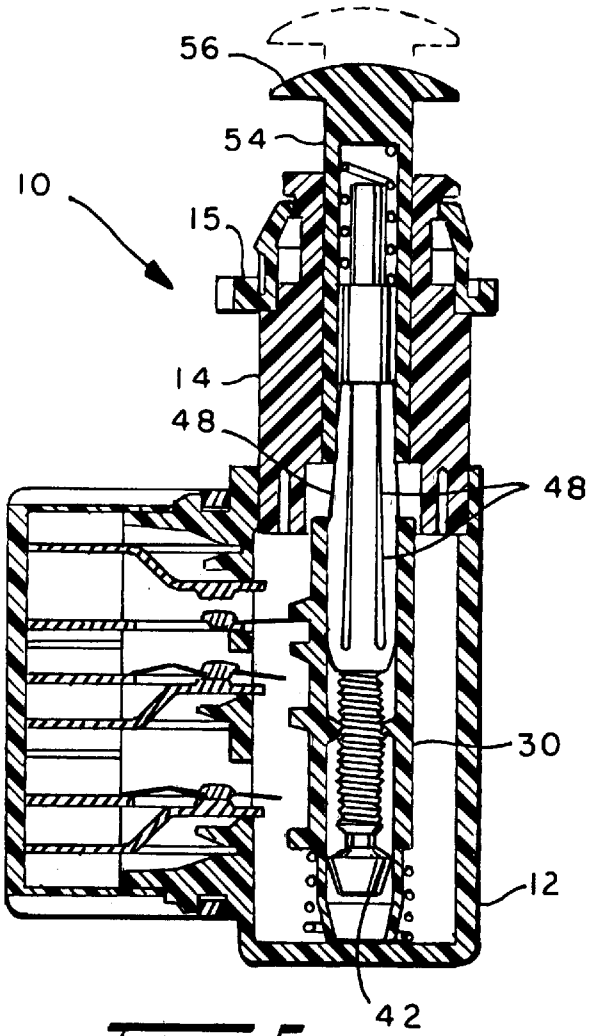

Referring to FIG. 5, the plunger has been subsequently depressed from the FIG. 4 position with respect to the upper body portion 14 by an amount further than that required to cause the actuator 30 to bottom out in the lower housing 12, which position is indicated in dashed outline for the button 56 in FIG. 5. The position shown in solid outline for the plunger 54 and button 56 in FIG. 5 shows the plunger 54 moved downwardly to a position where relative movement has occurred with respect to the adjustment member 42 which the plunger has telescoped downwardly as shown in FIG. 5. It will be understood that this telescoped position of the plunger relative to fingers 48 permits the plunger in button 56 to accommodate overtravel movement of the plunger as would be the case in the event of a brake light switch with the brake pedal at-rest position changing during service life or by the vehicle operator applying a force to the pedal arm causing compression of the pad limiting the pedal arm travel.

The present switch thus provides a unique and novel plunger actuated switch of the type wherein the plunger is normally in the depressed condition for the switch in the unactuated state. The switch assembly of the present invention provides for mounting of the switch initially against a user moveable operating member and adjusting the switch thereagainst to move the plunger relative to the internal actuator of the switch and latching the adjustment thereof Upon subsequent actuation of the switch and deactuation thereof the plunger is released by spring fingers to undergo relative movement with respect to the actuator for absorbing overtravel. An internal spring biases the plunger away from the actuator member to maintain the plunger actively against the user moved operating member. The present invention is particularly suitable as a brake light or stop lamp switch, but it will be understood is not limited to brake light applications.

Although the invention has hereinabove been described with respect to the illustrated embodiments, it will be understood that the invention is capable of modification and variation and is limited only by the following claims.

I claim:

1. A switch for actuation by user movement of an operating member comprising:

(a) a housing having at least one set of electrical switching contacts disposed therein;

(b) an actuator member disposed in said housing and moveable between a position actuating and a position de-actuating said switching contacts and including means biasing said actuator member to the actuating position;

(c) an adjustment member adjustably disposed on said actuator member for movement therewith, said adjustment member having a plurality of resiliently deflectable portions thereon;

(d) a plunger slidably received in said housing and having portions thereof extending from said housing and for being contacted by said operating member, wherein upon initial movement of said plunger by said operating member said plunger contacts said deflectable portions of said adjustment member and said actuator member is moved to the de-actuated position and further movement of said actuator member is arrested; and, upon continued movement of said plunger by said operating member said adjustment member is moved relative to said actuator member to an adjusted position and is retained in said adjusted position upon release of said plunger for return to an at-rest position wherein, upon subsequent strokes of said plunger by said operating member said deflectable portions of said adjustment member are moved to permit relative motion between said plunger and said adjustment member.

2. The switch defined in claim 1, wherein said deflectable portions of said adjustment member include a plurality of fingers having camming surfaces operative to contact said actuator member and cause said deflectable portions to be deflected.

3. The switch defined in claim 1, wherein said adjustment member includes a plurality of ratchet teeth and said actuator member includes pawl surfaces contacting said ratchet teeth for providing said relative movement between said adjustment member and said actuator in said adjusted position.

4. The switch defined in claim 1, further comprising a spring biasing said plunger away from said adjustment member.

5. The switch defined in claim 1, further comprising a spring biasing said actuator member toward said plunger.

6. The switch defined in claim 1, wherein said adjustment member includes a plurality of annular barbs and said actuator member includes projections thereon, operable to engage said barbs and ratchet thereover for providing said adjusted position.

7. A method of operating a switch comprising:

(a) disposing a set of switching contacts in a housing;

(b) disposing an adjustment member on an actuator and disposing said actuator in said housing;

(c) sliding a plunger in said housing and contacting said adjustment member and moving said adjustment member and actuator as a unit and de-actuating said set of switching contacts and limiting further movement of said actuator;

(d) further sliding said plunger and moving said adjustment member with respect to said actuator to an adjusted position and latching said adjustment member in said adjusted position on said actuator; and, (e) releasing said plunger from contact with said adjustment member and returning said actuator and adjustment member as a unit to a position actuating said set of switching contacts and upon subsequent movement of said unit to the limit of said actuator movement, moving said plunger relative to said adjustment member and absorbing overtravel.

8. The method defined in claim 7, wherein said step of releasing said contacting includes forming a plurality of fingers on said adjustment member and deflecting said fingers.

9. The method defined in claim 7, wherein said step of moving said actuator as a unit includes compressing a spring in said housing.

10. The method defined in claim 7, wherein said step of moving said adjustment member with respect to said actuator includes forming barbs on said adjustment member and ratcheting a pawl over said barbs.

11. The method defined in claim 7, wherein said step of moving said plunger with respect to said adjustment member includes disposing a spring between said plunger and said adjustment member and compressing said spring.

* * * * *